United States Patent [19]

Meroni et al.

[11] Patent Number: 4,932,201

[45] Date of Patent: Jun. 12, 1990

[54] METHOD TO ENGAGE AND INSERT SLIVER INTO FREE FIBER SPINNING UNITS AND DEVICE WHICH EMPLOYS THE METHOD

[75] Inventors: Roberto Meroni; Umberto Gerin, both of Pordenone; Fabio Lancerotto, Milan, all of Italy

[73] Assignee: Scaglia SpA, Brembilla, Italy

[21] Appl. No.: 372,851

[22] Filed: Jun. 29, 1989

[30] Foreign Application Priority Data

Jun. 29, 1988 [IT] Italy ..... 83428 A/88

[51] Int. Cl.[5] ..... D01H 15/02; D01H 1/40; D01H 9/18; D01H 1/12

[52] U.S. Cl. ..... 57/279; 57/90; 57/261; 57/263; 57/281; 57/408

[58] Field of Search ..... 57/261-263, 57/279, 280, 90, 281, 408; 19/159 R, 159 A

[56] References Cited

U.S. PATENT DOCUMENTS

| | | | |
|---|---|---|---|
| 4,078,369 | 3/1978 | Brandis | 57/90 X |
| 4,150,534 | 4/1979 | Raasch | 57/281 |
| 4,537,018 | 8/1985 | Tooka | 57/90 |
| 4,735,040 | 4/1988 | Pircher | 57/90 X |
| 4,809,495 | 3/1989 | Condotta | 57/408 |
| 4,852,218 | 8/1989 | Lenaertz | 19/159 A |

*Primary Examiner*—John Petrakes
*Attorney, Agent, or Firm*—Antonelli, Terry, Stout & Kraus

[57] ABSTRACT

A method is disclosed for automatically engaging and inserting sliver fed from a spinning can into a spinning unit by means provided on a movable unit which comprises providing a spinning can containing a quantity of sliver and positioning a segment of sliver located between a coiler and the spinning can on a vertical plane and a horizontal plane. A first portion of the segment of sliver is clamped, engaged and gripped by gripping means at a second portion other than at the first portion. The sliver is broken at a portion between the first and second portions to leave a first broken end of the sliver adjacent the first portion and a second broken end of the sliver adjacent the second portion. The second broken end of the sliver is positioned in correspondence with an intake of a condenser of the spinning unit, and is introduced in the intake of the condenser. Substantially simultaneously air is introduced under pressure downstream of the intake of the condenser. The second broken end of the sliver is then released from the gripping means and is aspirated and thrust into the spinning unit. The movable unit is then repositioned during an inactive phase, and a spinning process is started on the spinning unit. A device for performing the method is also disclosed.

16 Claims, 4 Drawing Sheets

METHOD TO ENGAGE AND INSERT SLIVER INTO FREE FIBER SPINNING UNITS AND DEVICE WHICH EMPLOYS THE METHOD

This invention concerns a method to engage and insert sliver into free fibre spinning units. To be more exact, the invention concerns a method for the automatic engagement of sliver held in cans feeding spinning units and the insertion of the sliver into the condenser of the spinning unit, this condition being suitable for the automatic or manual restarting of the spinning unit.

The method provides for these operations to be carried out advantageously, but not only, in cooperation with a movable unit that performs automatic filling of sliver into empty cans.

The invention also concerns a device which employs the above method.

Methods and devices suitable to carry out the engagement and automatic insertion, into a free fiber spinning unit, of sliver taken from cans that feed such a spinning unit are not known in the state of the art.

It is known that in the spinning field manual systems are still mainly employed for the conveying and positioning of cans holding sliver of fibers at the feeding positions on the spinning units.

Full cans coming from intermediate storage points or directly from the sliver production machines are conveyed on appropriate trolleys by the personnel serving the machines and are positioned near the machines to form momentary storage zones.

The spinning machine operatives use the full cans by substituting them for the empty cans and vice versa and insert the end of the new sliver into the relative spinning unit, thus arranging for start-up of a new spinning process. This start-up may be performed by hand by the machine operative or automatically by means with which the spinning machine may be equipped.

Many proposals have been made to overcome the problem of replacement of empty cans with full cans. Among such proposals we may cite and refer hereinafter in this disclosure, without thereby restricting the scope of the invention, to a solution which provides for a movable unit able to run along at least one side of the spinning machine and suitable to fill an empty can in its working position.

For this filling process the sliver is taken from a sliver container of a large size which generally holds a quantity of sliver which is a multiple of that held in a spinning can, the container being momentarily firmly secured to the movable unit.

When the can has been filled with fresh sliver, it is necessary to tackle the problem of how to engage the end of the sliver and insert it suitably into the corresponding spinning unit in such a way that it will be correctly positioned for start-up of the new spinning process.

Applicants have studied, tested and obtained a method and a device suitable to overcome the problem of the engagement and insertion of the end of the sliver into spinning units, which are advantageously of the free fiber type.

As we said above, the invention is applied advantageously to machines employing the free fiber spinning system or open-end machines but can also be used in other textile machines which process sliver or roving and in which it is necessary to manipulate the sliver or roving so as to insert it in appropriate positions.

The invention provides for a segment of sliver of a desired length to emerge from a spinning can when that can is located in its working position in correspondence with a spinning unit.

The segment of sliver is so positioned that it is accessible to means which can manipulate it and which in this example are borne on the movable unit.

In this case the segment of sliver is positioned momentarily between the outlet of the means distributing sliver in the cans, or coiler, and located on the movable unit and the upper surface of depositing sliver in the can.

An assembly to position the segment of sliver determines the position of that segment on the vertical plane and horizontal plane so as to cooperate with an element that clamps the segment of sliver.

A manipulator performs the engagement and gripping of the segment of sliver in a zone other than that of the clamping; this zone is more outwardly placed in relation to the movable unit than the clamping zone and is closer to the spinning unit.

The manipulator carries out, in succession, the breakage of the sliver, the rotation of the end of the sliver thus broken so as to face it towards the spinning unit, the approach of the sliver to the condenser of the spinning unit and the insertion of that end into the condenser by a desired length.

During the step of insertion of the end of the sliver into the condenser, air under pressure is injected into the condenser downstream of the insertion point by a suitably fed movable ejector comprised on the movable unit.

Injection of air into the condenser causes the aspiration and conveying of the end of the sliver, which is thrust into the spinning unit in correspondence with a small card of the spinning unit.

During this step, the manipulator has released its grip on the segment of sliver.

The other end of the torn sliver remains emerging from the sliver distributor of the movable unit and will form the first portion of sliver deposited in the next filling of the can.

Suitable motor means and actuators are fitted to the movable unit to carry out the above operations with each spinning unit requiring them.

Sensors are also comprised to control the individual steps and to enable the successive steps to be carried out.

As we said earlier, we have described so far a preferred embodiment of the invention in relation to a movable unit that fills empty cans at their usage site.

The invention will be applied in the same way to other embodiments, such as those which provide, for instance, for replacement of an empty can with a full one where the full can is conveyed by a movable unit to the spinning unit requiring an exchange of cans and where the empty can is loaded on the movable unit so as to be conveyed to suitably equipped storage zones.

The attached figures, which are given as a non-restrictive example, show the following:

Figure 5:
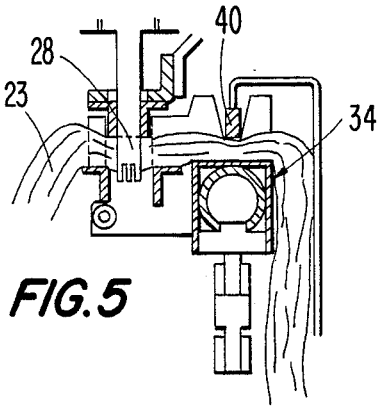
Figure 6A:
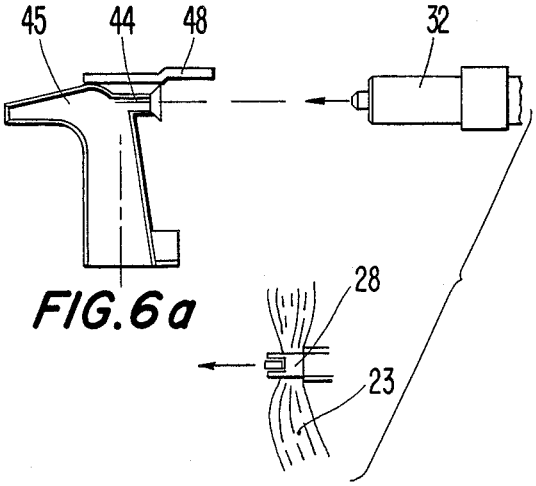
Figure 6B:
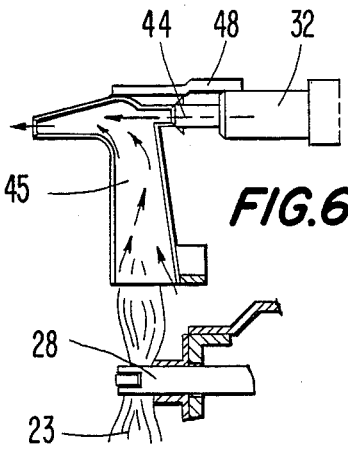
Figure 6C:
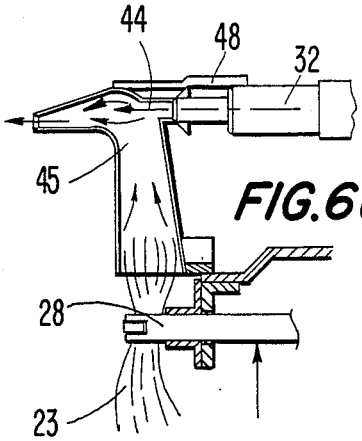
Figure 7:
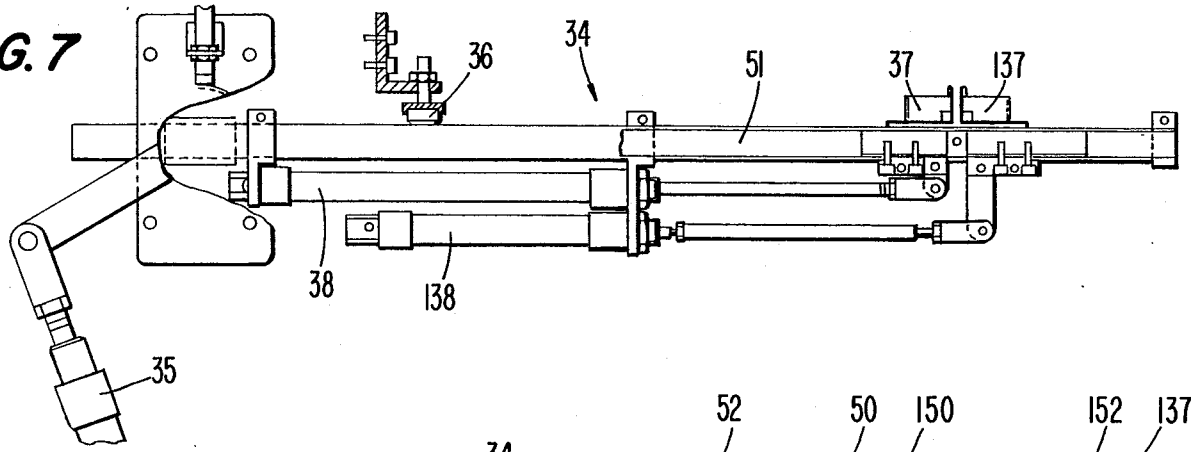
Figure 8:
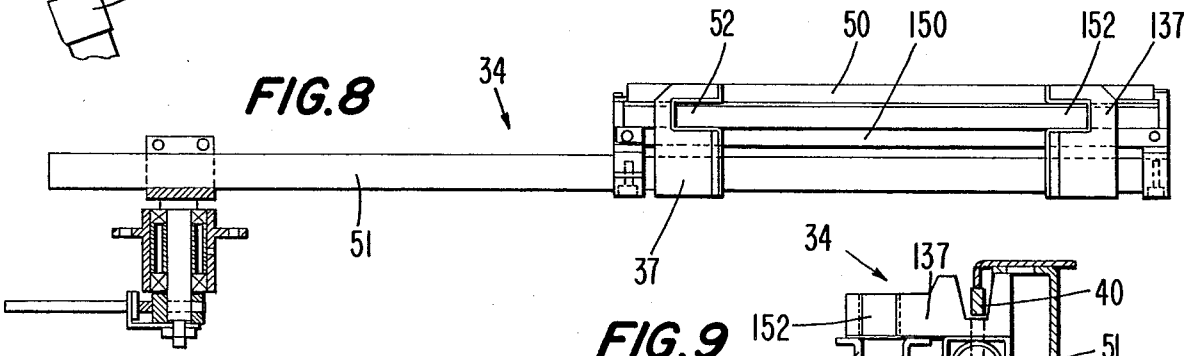

FIGS. 3*a* to 3*g* show diagrams of the steps of the method of the invention;

FIGS. 4*a* to 4*d* show diagrams of the positions of an assembly that positions the segment of sliver;

FIG. 5 gives a diagram of a detail of a step of the method according to the invention;

FIGS. 6*a* to 6*c* show diagrams of the steps of insertion of the sliver into a spinning unit;

FIG. 7 is a front view of the assembly that positions the segment of sliver;

FIG. 8 is a view from above of the assembly of FIG. 7; and

Figure 9:
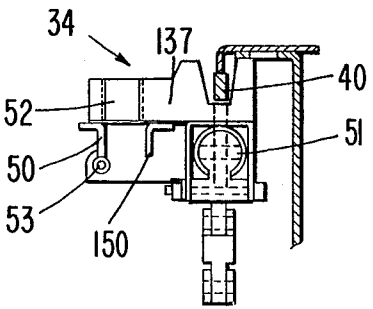

FIG. 9 is an enlarged partial side view of the assembly of FIG. 7.

Figure 1:
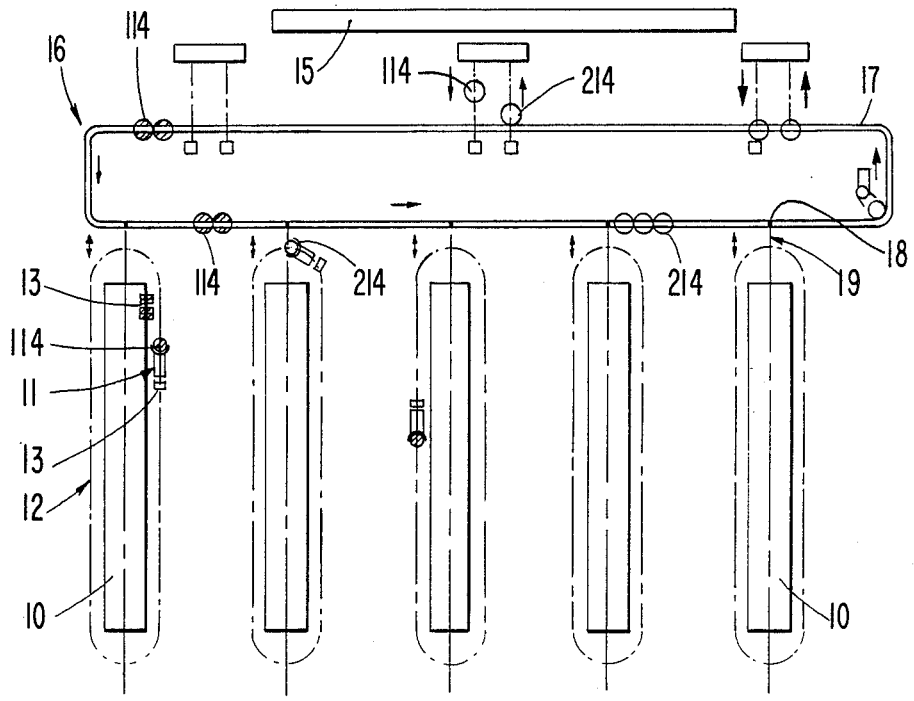
FIG. 1 shows a lay-out of a spinning shop in which this invention can be applied.

FIG. 1 shows a lay-out of a spinning shop in which open-end spinning machines 10 are served by movable units 11 able to run on rails 12 near the working sides of the open-end spinning machines 10.

Each spinning unit of the spinning machine 10 is fed with a sliver of fibers 23 (see FIGS. 3*a* et seq.) held in a spinning can 13 suitably positioned before the respective spinning unit 20 in the lower part of the spinning machine 10.

When the spinning can 13 has been emptied, it is withdrawn from its position at the spinning machine 10 by the movable unit 11, is re-filled with sliver 23 and then repositioned at the spinning machine 10.

Figure 2:
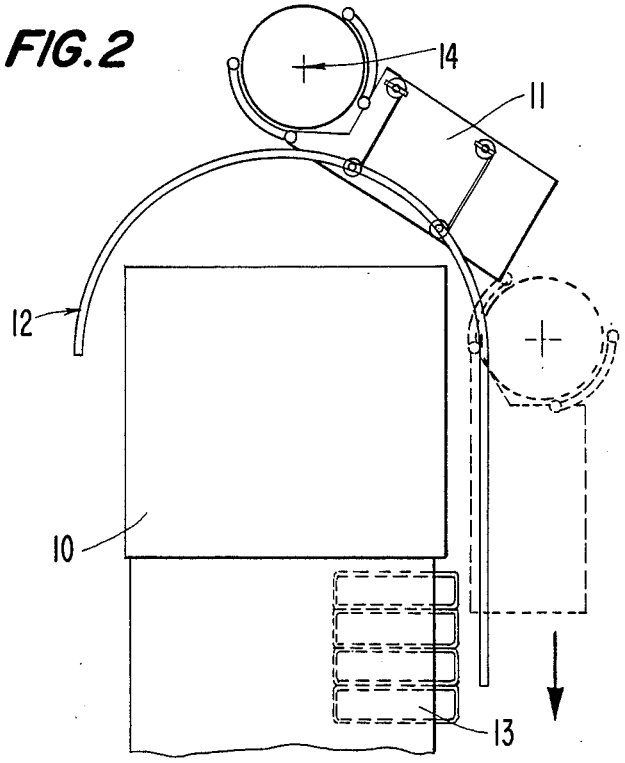
FIG. 2 shows an enlarged detail of FIG. 1.

Sliver 23 to re-fill the spinning can 13 is taken from a large-sized container 14, which is generally employed at appropriate drawing frames and travels firmly fixed to the movable unit 11 during its travel along the spinning machine or machines 10 (see FIG. 2).

In the lay-out of FIG. 1, a temporary storage zone 16 for full cans 114 and empty cans 214 is provided between the sliver production shop, for instance the shop for drawing frames 15, and the spinning shop.

The full cans 114 coming from the drawing frame shop 15 are sent on a movable conveyor circuit 17, which makes them pass one of the ends of the spinning machines 10.

At this position there is a connecting junction 18, through which the full cans 114 are sent on a transfer path 19 connected to the runway of the movable units 11, which collect the full cans whenever a signal advises that they are required.

Empty cans 214 follow the opposite path.

FIG. 2 gives a diagram of the movable unit 11 running on a rail 12 at one end of the spinning machine 10. The position marked with lines of dashes of the movable unit 11 refers to the first working position on the spinning machine 10.

Figure 3A:
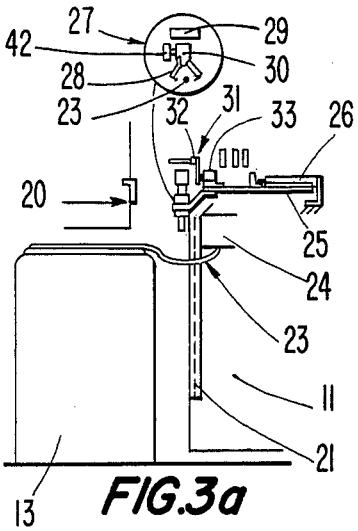
Figure 3B:
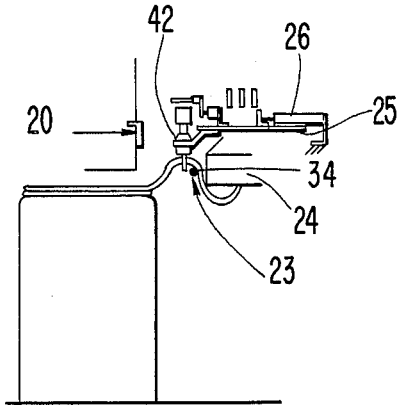

FIG. 3*a* gives a diagram of the first step in the cycle, where the contents of the spinning can 13 are exhausted, the can being located in its working position below the spinning unit 20.

A positioner assembly 22 (see FIGS. 4*a* et seq.) to position a segment of sliver 23 stretching between the spinning can 13 and a coiler 24 is included in an appropriate space 21 on the movable unit 11.

This positioner assembly 22 is shown in FIGS. 4*a*–4*d* in the various working positions relating to the connected steps of FIGS. 3*a*–3*d* but is always rotated by 90° on a vertical plane as compared to its arrangement in FIGS. 3*a*–3*d*.

An assembly-holder support 25 is also included in the movable unit 11 and is connected to an actuation means, for instance a jack 26, which moves the assembly-holder support 25 on a horizontal plane. A manipulator 27 is fitted to the assembly-holder support 25 and consists of grippers 28 connected to a means for rotary actuation on a vertical axis, for instance a first rotary cylinder/piston actuator 29, and of a gripper actution means 30 and of a means for rotary actuation of the grippers 28 on a horizontal axis, for instance a second rotary cylinder/piston actuator 42.

In FIG. 3*a* the manipulator 27 is shown separately, enlarged and rotated by 90° on a vertical plane as compared to its position in the figure.

An injection assembly 31 to inject air under pressure within the spinning unit 20 is also fitted to the assembly-holder support 25 and consists of an ejector 32 connected to suitable means to feed compressed air and of a rotary actuation means, for instance a third rotary cylinder/piston actuator 33.

Figure 4A:
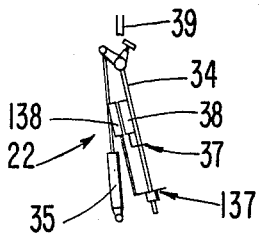
Figure 4B:
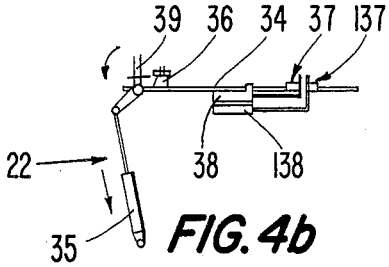

The positioner assembly 22 comprises an arm 34 which is actuated by a suitable actuator means, for instance a jack 35, so as to be arranged on a substantially horizontal plane against an abutment 36 (see FIG. 4*b*). The arm 34 bears two sliders 37–137 driven by respective jacks 38–138 along the arm 34 in opposite directions to each other.

Vertical lifting of the arm 34 lifts the segment of sliver 23 upwards (FIG. 3*b*); attainment of the end-of-travel position is detected by a first sensor 39, which by means of the jacks 38–138 actuates the sliders 37–137 to bring about the required positioning of the sliver 23 on a horizontal plane.

Attainment of the end-of-travel position of the arm 34 coincides with clamping of the segment of sliver 23 in cooperation with a clamping element 40 (see FIG. 5) solidly fixed to the structure of the movable unit 11.

Attainment of the end-of-travel position of the arm 34 coincides also with positioning of the segment of sliver 23 between the open grippers 28 of the manipulator 27.

Figure 3C:
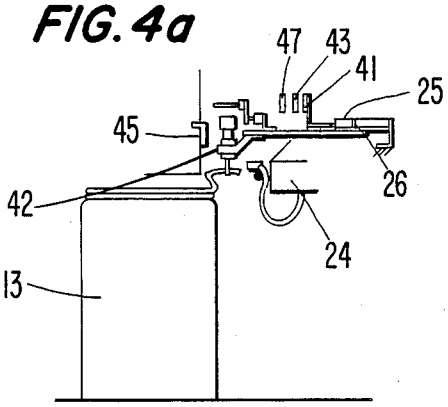
Figure 3D:
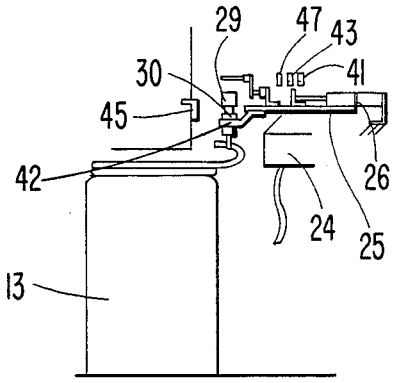

The gripper actuation means 30 closes the grippers 28 on the sliver 23; the jack 26 then actuates the assembly-holder support 25 and thus obtains breakage of the segment of sliver 23 between the clamping element 40 and the grippers 28 (FIG. 3*c*).

During its horizontal travel the assembly-holder support 25 cooperates with a second sensor 41, which causes actuation of the first rotary cylinder/piston actuator 29 of the manipulator 27, which obtains a rotation of 180° of the end of the broken sliver 23 on a vertical axis.

Likewise, the second sensor 41 actuates the second rotary cylinder/piston actuator 42 of the manipulator 27, which obtains a rotation a of 90° of the end of the torn sliver 23 (see FIG. 3*e*) on a horizontal axis.

Figure 4C:
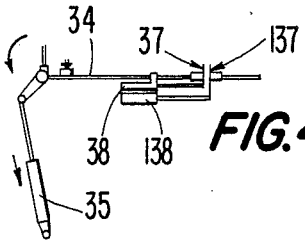
Figure 4D:
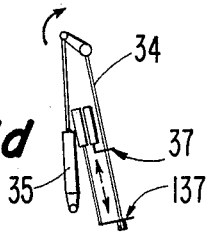

At the same time, due to the action of the second sensor 41 the jack 35 has brought the arm 34 to the space 21 after the sliders 37–137 have been returned to their inactive position by the action of the respective jacks 38–138 (see FIG. 4*d*).

The assembly-holder support 25 during its travel cooperates with a third sensor 43 which actuates the third rotary cylinder/piston actuator 33, which in turn causes rotation (see FIG. 3*e*) of the ejector 32 and positions the latter substantially on the same axis as an air-intake pipe 44 of the condenser 45 of the spinning unit 20 (see FIG. 6*a*).

Figure 3E:
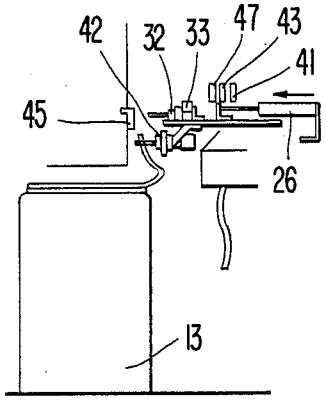
Figure 3F:
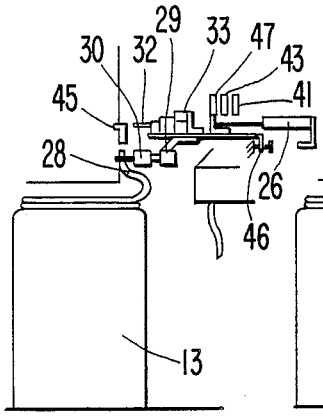

At an end-of-travel adjustable stop referenced with 46 in FIG. 3*f*, the assembly-holder support 25 cooperates with a fourth sensor 47 that actuates the third rotary cylinder/piston actuator 33 to position the ejector 32 in line with the pipe 44, this positioning being controlled by an abutment 48.

Figure 3G:
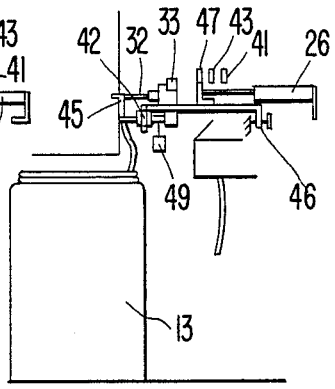

The sliver 23 is vertically coaxial with the intake of the condenser 45 and is introduced thereinto by the vertical action of a jack 49 (see FIG. 3*g*).

Introduction of air into the pipe 44 and the simultaneous release of the sliver 23 by the grippers 28 causes insertion of the end of the sliver 23 by aspiration into the condenser 45 and the thrusting of the sliver 23 into the spinning unit 20 itself.

According to a variant, the introductions of air and of the sliver 23 into the condenser 45 take place in directions at angles less than 90° to each other, including 0°.

The movable unit 11 itself can give the signal that the spinning unit 20 is already arranged to re-start spinning, and this can take place by hand or automatically by means of means included in the more automated open-end spinning machines 10.

When all the means have been re-set to their inactive position, the movable unit 11 is ready to operate on a successive spinning unit 20 which makes a request therefor.

FIGS. 7, 8 and 9 show a constructional embodiment of the arm 34 of the device according to the invention. This arm 34 comprises two sliver holders 50–150 connected to a guide 51 and cooperating with the sliders 37–137.

These sliver holders 50–150 are parallel to each other and spaced apart to enable the grippers 28 to be introduced in the step of engagement of the sliver 23 in cooperation with openings 52–152 included in the sliders 37–137 respectively. The sliver holder 50 is also able to move on a pivot 53 so as to rotate when the segment of sliver 23 is broken by the grippers 28, which move away on a horizontal plane.

We claim:

1. A method for automatically engaging and inserting sliver fed from a spinning can into a spinning unit by means provided on a movable unit comprising:

providing a spinning can containing a quantity of sliver;

positioning a segment of sliver located between a coiler and said spinning can on a vertical plane and a horizontal plane;

clamping a first portion of said segment of sliver;

engaging and gripping said sliver by gripping means at a second portion other than at said first portion;

breaking said sliver at a portion between said first and second portions to leave a first broken end of said sliver adjacent said first portion and a second broken end of said sliver adjacent said second portion;

positioning said second broken end of said sliver in correspondence with an intake of a condenser of said spinning unit;

introducing said second broken end of said sliver in said intake of said condenser and substantially simultaneously introducing air under pressure downstream of said intake of said condenser;

releasing said second broken end of said sliver from said gripping means;

aspirating and thrusting said second broken end of said sliver into said spinning unit;

repositioning said movable unit during an inactive phase; and starting a spinning process on said spinning unit.

2. A method as claimed in claim 1, wherein said spinning unit is of spinning machines employing a free fiber spinning system.

3. A method as claimed in claim 1, wherein the step of providing a spinning can containing a quantity of sliver includes filling said spinning can with sliver distributed from said movable unit.

4. Method as claimed in claim 1, in which the clamping of the first portion of the segment of sliver takes place automatically at the end of the vertical and horizontal positioning of the sliver.

5. Method as claimed in claim 1, in which said second portion of said segment of sliver is already in position for said engaging and gripping at the end of its vertical and horizontal positioning.

6. Method as claimed in claim 1, in which the breaking of the sliver takes place by the substantially horizontal sliding of the engagement and gripping point in relation to the clamping point.

7. Method as claimed in claim 1, in which the second broken end of the sliver is rotated by 180° on a vertical axis of rotation.

8. Method as claimed in claim 1, in which the second broken end of the sliver is rotated by 90° on a horizontal axis of rotation.

9. Method as claimed in claim 1, in which the introduction of air and of the second broken end of the sliver into the condenser take place in directions substantially at a right angle to each other.

10. Method as claimed in claim 1, in which the introduction of air and of the second broken end of the sliver into the condenser take place in directions at an angle of less than 90° to each other, including 0°.

11. A device for automatically inserting sliver fed from a spinning can into a spinning unit, comprising:

a spinning can;

a spinning unit having a condenser;

a movable unit movable relative to said spinning unit;

positioning means for positioning a segment of sliver located between a coiler and said spinning can in a vertical plane and a horizontal plane, said positioning means being provided on said movable unit;

clamping means for clamping a first portion of said segment of sliver;

engaging means to engage a second portion of said segment of sliver;

support means for supporting said engaging means on said movable unit and for moving said engaging means in a horizontal plane relative to said clamping means, thereby allowing breakage of said sliver between said first and second portions to leave a first broken end adjacent said first portion and a second broken end adjacent said second portion;

manipulating means for manipulating said second broken end of said sliver relative to said condenser of said spinning unit;

injection means to inject air under pressure into said condenser of said spinning unit; and control means for controlling said movable unit, said positioning means, said clamping means, said engaging means, said support means, said manipulating means and said injection means to allow said second broken end of said sliver to be inserted in said condenser.

12. Device as claimed in claim 11, in which said positioning means comprises an arm on which sliders slide which position the sliver.

13. Device as claimed in claim 12, in which the sliders slide on the arm in opposite directions.

14. Device as claimed in claim 12, in which the sliders include openings for cooperation with said engaging means and said engaging means comprise grippers.

15. Device as claimed in claim 12, in which the arm of the positioning means is arranged such that it emerges momentarily from a space in the movable unit.

16. Device as claimed in claim 11, in which the manipulating means and the injection means are solidly fixed to the support means.

* * * * *